US007743435B2

(12) United States Patent
Serret

(10) Patent No.: US 7,743,435 B2
(45) Date of Patent: Jun. 29, 2010

(54) SELF ADJUSTING TOILET BOLT ASSEMBLY FOR CONNECTING A TOILET BOWL TO A CLOSET FLANGE

(76) Inventor: Raymond J. Serret, 600 Bedford Rd., Pleasantville, NY (US) 10570

( * ) Notice: Subject to any disclaimer, the term of this patent is extended or adjusted under 35 U.S.C. 154(b) by 550 days.

(21) Appl. No.: 11/779,591

(22) Filed: Jul. 18, 2007

(65) Prior Publication Data

US 2008/0016606 A1 Jan. 24, 2008

(51) Int. Cl.
*E03D 11/14* (2006.01)

(52) U.S. Cl. ..... 4/252.1; 4/252.3; 4/252.4

(58) Field of Classification Search ..... 4/252.1–252.5; 285/56–58; 411/172, 173, 120, 107, 104, 411/999

See application file for complete search history.

(56) References Cited

U.S. PATENT DOCUMENTS

| | | | | |
|---|---|---|---|---|
| 4,907,301 | A * | 3/1990 | Tucker | 4/252.5 |
| 5,421,036 | A * | 6/1995 | Stevens et al. | 4/252.1 |
| 5,898,954 | A * | 5/1999 | Provenzano | 4/252.1 |
| 6,254,141 | B1 | 7/2001 | Piper | |

* cited by examiner

*Primary Examiner*—Khoa D Huynh
*Assistant Examiner*—Janie Christiansen
(74) *Attorney, Agent, or Firm*—Lackenbach Siegel, LLP; Andrew F. Young

(57) ABSTRACT

A self adjusting toilet bolt assembly provides an anchor member for connecting a toilet bowl to a closet flange which allows use of downward 5/16" stud travel through a standard width dimension slotted opening in the closet flange incident making connection of a toilet bowl to the closet flange. This result is made possible by use of apertures in an anchor member body lower body portion extending between two lower body portion wall parts providing clearance for the stud to pass unobstructedly in the flange slotted opening.

11 Claims, 6 Drawing Sheets

SELF ADJUSTING TOILET BOLT ASSEMBLY FOR CONNECTING A TOILET BOWL TO A CLOSET FLANGE

BACKGROUND OF THE INVENTION

1. Field of the Invention

The present invention relates to a self adjusting toilet bolt assembly for connecting a toilet bowl to a closet flange and, more particularly to such an assembly wherein a tightening stud or bolt assembly component can adjust downwardly in length when the assembly is tightened. Beneficially, the proposed invention allows unencumbered placement of a covering cap over the connecting hardware extending above the top surface of the toilet bowl base and eliminates the need to cut a bolt member.

2. Description of the Related Art

In the past, the most commonly used closet bolt employed for connecting a toilet bowl to a closet flange was a fixed length component having a diameter of either ¼" or 5/16". The closet bolt was conveniently made longer than necessary to accommodate floor, flange and toilet height variation during installation. For that reason and following connection, it was necessary to cut off an excess top length portion of the threaded stud or bolt or rod member extending above the tightened hold down nut so that the connection hardware could be hidden with an attractive covering cap. If the excess top length portion was not removed, the cap piece could not be seated properly in hardware concealment position. Additionally, it was also recognized that an uncovered hardware assembly provided a debris gathering area in the bathroom and that the covering cap enabled easy cleaning for a beneficial health benefit.

U.S. Pat. No. 6,254,141 to Piper, the entire contents of which are herein incorporated herein by reference, discloses an adjustable length closet fastener in which a length adjustment bolt can be adjusted downwardly by rotating it in a length adjustment sleeve, which length adjustment sleeve passes through an arcuate flange slot in a mounting ring part of the closet flange. The width of the arcuate flange slot is essentially of a standard diameter being fractionally or slightly wider than 5/16". A shortcoming of the patented Piper fastener is that it cannot be used with a 5/16" bolt since an internally threaded sleeve receptive of a 5/16" bolt must include an outer member mandating an outer dimension in excess of 5/16", such excess providing that the internally threaded sleeve cannot fit into the standard arcuate flange slot. Accordingly, the patented fastener is useable only with a ¼" bolt.

It is therefore desirable that a self adjusting toilet bolt assembly useable with both ¼" and 5/16" diameter threaded studs or bolts be provided.

It is additionally recognized, that conventional use of steel assembly members promotes rust development in the moist bathroom environment and that brass and stainless steal bolts have been used as substitutes to overcome this corrosion detriment. Unfortunately, this use of stainless steal contrasts with the need to adjust the bolt length by cutting to fit each installation. Thus, since stainless steal bolts are much harder and are impossible or highly difficult to cut with a conventional hand-held metal saw brass bolts may be readily cut with a conventional hand-held metal saw and have become the standard material in use. Ultimately, while the strength and corrosion resistance of stainless steal makes it a more desirable metal, the use of brass has been widely adopted because of the need to cut bolts to length after installation due to the non-adjustability of the standard assembly configuration.

SUMMARY OF THE INVENTION

It is an object of the invention to provide a self adjusting toilet bolt assembly which overcomes at least one of the drawbacks of the related art.

Another object is to provide a self adjusting toilet bolt assembly that can be used with both ¼" and 5/16" diameter studs and bolts, and which enables the use of full 5/16" studs and bolts without compromising attachment or positioning strength.

Another object is to provide a self adjusting toilet bolt assembly which makes it unnecessary to cut off any length portion of the bolt once tightening with the hold down nut has been completed.

Another object of the present invention is to provide a self adjusting toilet bolt assembly that enables self driving of a 5/16" stud with a separable head nut that also adjusts the ultimate assembly length to the minimum necessary to affix the toilet to a closet mounting flange.

The present invention provides a self adjusting toilet bolt assembly provides an anchor member for connecting a toilet bowl to a closet flange which allows use of downward 5/16" stainless steal or brass stud travel through a standard width dimension slotted opening in the closet flange incident making connection of a toilet bowl to the closet flange. This result is made possible by use of apertures in an anchor member body lower body portion extending between two lower body portion wall parts providing clearance for the stud to pass unobstructedly in the flange slotted opening and connected with a bottom web member.

In accordance with the invention, the bolt assembly includes a threaded stud and an anchor member in which the stud is received. The anchor member includes an upper body portion and a lower body portion, the upper body portion having an internally threaded bore, the lower body portion comprising two spaced apart wall parts which extend down from the upper body portion. A retainer web is carried fixedly at a lower terminus of the wall parts. The closet flange has arcuate course slotted openings to which the anchor member lower body portion is slidably mounted, the mounting being one wherein the retainer web locates at an underside of the closet flange and disposes laterally of the slotted opening to capture the anchor member on the closet flange. The wall parts locate in the flange slotted opening and a first washer encircling the spaced wall parts and retain-ably positioned proximate the point where the wall parts have juncture with the upper body part is set on a top surface of the closet flange. The threaded stud is threaded into the upper body portion and an opening in a toilet bowl base is received over the threaded stud where the stud extends up from the closet flange. Optionally, a second washer encircling the stud is set on top of the toilet bowl opening. A hold down nut threaded onto an upper end of the stud is rotated down on the stud until the nut encounters an interference on the stud that produces unitary rotation of the stud and hold down nut along the threads into the anchor member. The stud thus is moved down to thereby reduce the length of the stud extending above the top surface of the toilet bowl base and eliminating any interference the upstanding stud and hold down nut would present to securement of a decorative concealment cover over the connection hardware The interference producing unitary rotation of the stud with the hold down nut can be effected by engagement of the hold down nut with any suitable system known to those of skill in the assembly arts, including the use of an unthreaded or narrowed-thread segment on the stud, or with a deposit of a self hardening material such as LOCTITE® applied on the a segment of the threads.

The spacing of the wall parts of the anchor member lower body part portion provides apertures in the lower body portion. With the wall parts disposed in the closet flange slotted opening, the apertures provide a clearance space presence allowing the stud to move down between these wall parts. It is this arrangement that allows presence of a 5/16" stud in the closet flange slotted opening which opening is only slightly larger than 5/16". Prior art closet bolt types employing an internal threaded sleeve in which a stud is received and which sleeve extends down through the closet flange slotted opening, is limited in use to a maximum stud diameter of 1/4". A prior art sleeve companion to a 5/16" stud has an external sleeve diameter too large to pass through the slotted opening. Thus, a 5/16" stud cannot be used with the prior referenced Piper patent.

The above, and other objects, features and advantages of the present invention will become apparent from the following description read in conduction with the accompanying drawings, in which like reference numerals designate the same elements.

DETAILED DESCRIPTION OF THE PREFERRED EMBODIMENTS

Figure 1:
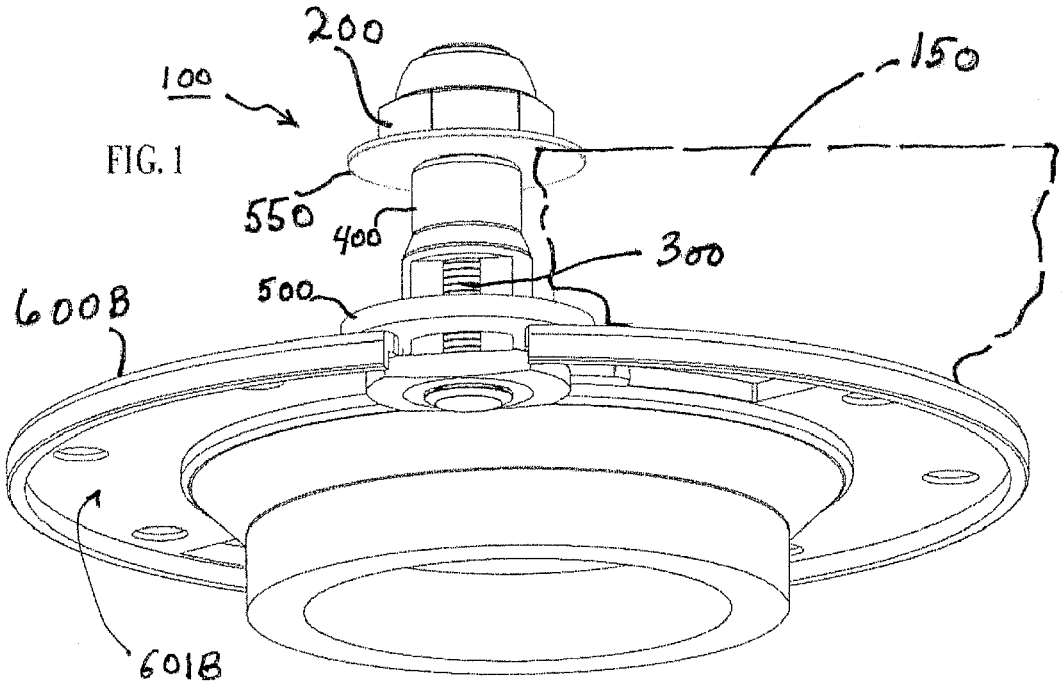
FIG. 1 is a bottom front perspective depicting the toilet bolt assembly disposition when it is anchored in place to a closet flange extension ring, the flange extension ring being a metal type, a portion of a toilet bowl base part which has been connected to the closet flange being shown in phantom depiction.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Referring to FIGS. 1 through 4, the self adjusting toilet bolt assembly 100 comprises as components, a hold down nut 200, a threaded stud 300, an anchor member 400, a first washer 500 made of nylon, and a second metal washer 550. Assembly 100 is interfitted with optional plastic closet flanges 600A or metal closet flanges 600B having assembly entry openings 800 with opposing side walls 802, 802 for sliding access along a sliding direction B.

Figure 2:
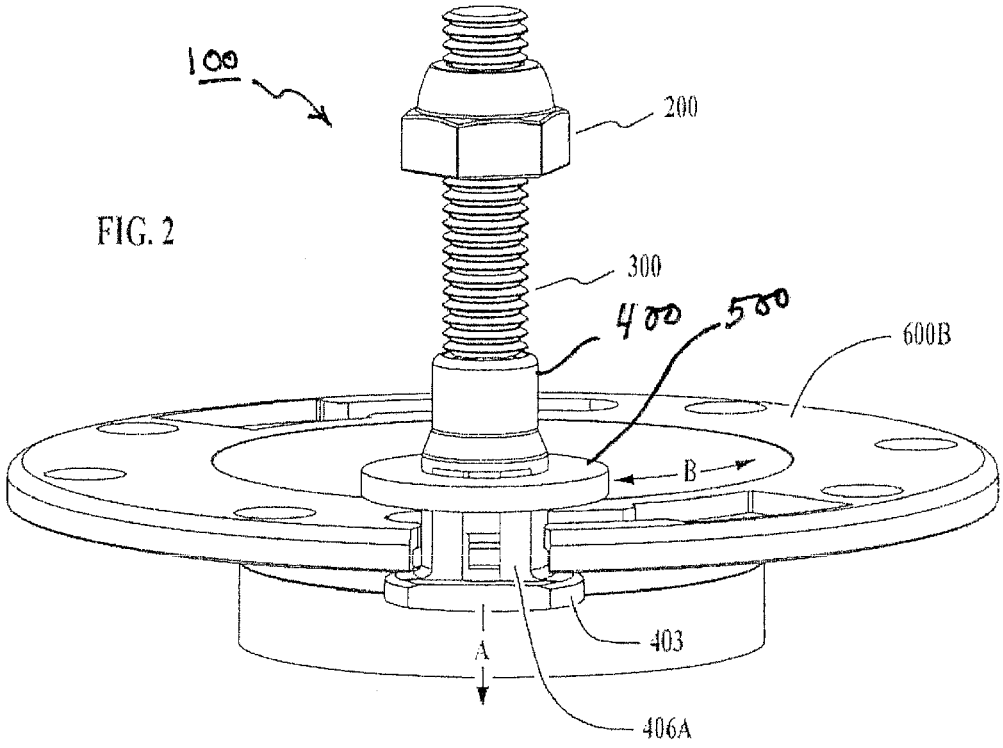
FIG. 2 is top perspective view of the bolt assembly shown in FIG. 1 except the assembly tightening bolt is disposed in bolt assembly untightened disposition without the top washer.

Referring additionally to FIGS. 5-8, anchor member 400 includes an upper body portion 415 and a lower body portion 420. Upper body portion 415 comprises a cylindrical part 416 and a lower frusto-conical part 408 includes defining a skirted structure. Upper body portion 415 includes a bore passage extending there through, the bore passage being internally threaded as at 401. Lower body portion 420 comprises a pair of spaced apart wall parts 405A and 405B, these extending downwardly from the skirted structure part 408, the wall parts 405A, 405B being arranged at reciprocal locations on the anchor member and having opposing cut-away wall faces 406A, 406B respectively. A retainer web part 403 includes a bottom opening 402 and is carried at the bottom of the wall parts 405A and 405B, this web structure being provided to be received under a lower face 601B of flange 600B (FIG. 2). Spaces on the anchor member intermediate the wall parts 405A, 405B, define apertures 417, 417 in the lower body portion 420, these apertures being disposed at oppositely located sides of the lower body portion on cut away wall faces 406A, 406B respectively. The inner surfaces of the depicted wall parts are devoid of any threaded formation, although threads on these surfaces can be optionally provided for additional strength, the threads being identical with threads 401.

Figure 3:
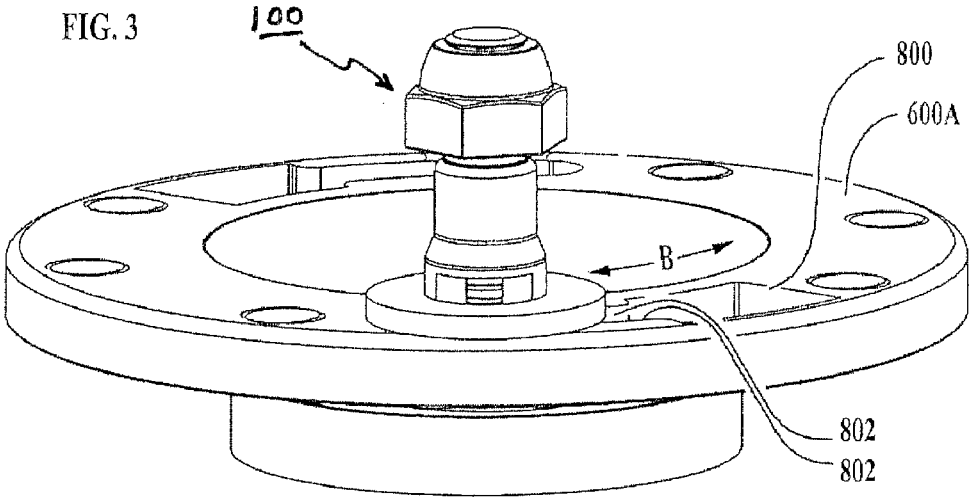
FIG. 3 is a top perspective view similar to FIG. 1 except the closet flange extension ring is a plastic type.

Stud 300 receives on a top end thereof, the hold down nut 200, while at an opposite or bottom stud end 418 (FIG. 5) is the end inserted into the top of the threaded bore of the upper body portion 415. The stud 300 can be threaded into the bore passage threads 401 and down below that passage such as to locate a lower tip end segment of the stud slightly below the retainer web parts 402, 403, the wall part lengths immediately above the retainer web parts 402, 403 when the stud lower tip end segment is so situated, are disposed between oppositely facing slot walls 802, 802 which define arcuate course slotted openings 810 in the closet flange, the said slotted openings 810 each having an enlarged entry opening as at 800 (FIG. 3).

Figure 4:
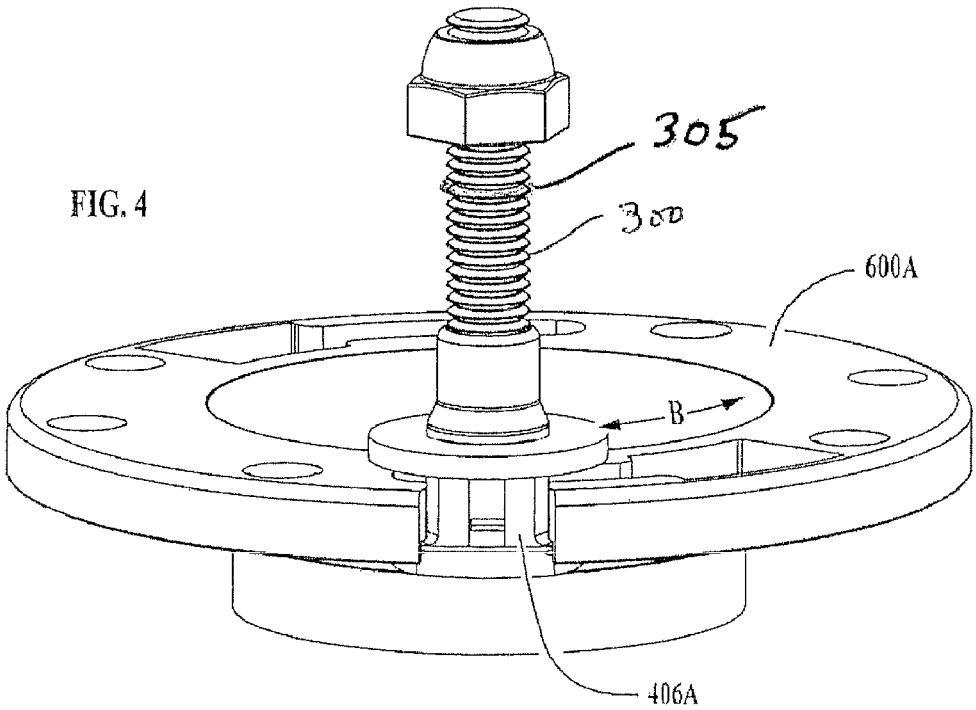
FIG. 4 is a view similar to FIG. 3 except the assembly tightening bolt is disposed in bolt assembly untightened disposition.
Figure 7:
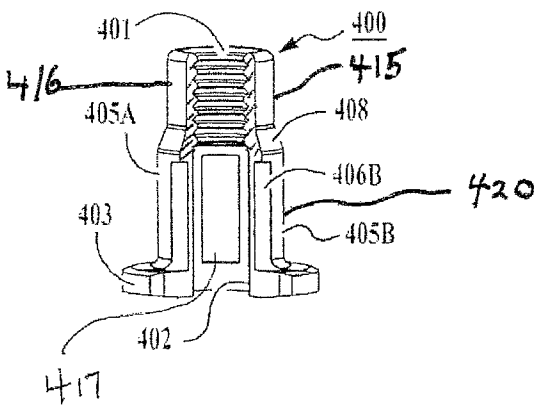
FIG. 7 is a partial cutaway perspective section view of the anchor member component illustrating the upper internal threaded bore passage of the anchor member upper body portion, the threaded stud of the assembly not being shown, the anchor member integral lower body portion wall parts optionally being devoid of threads.
Figure 8:
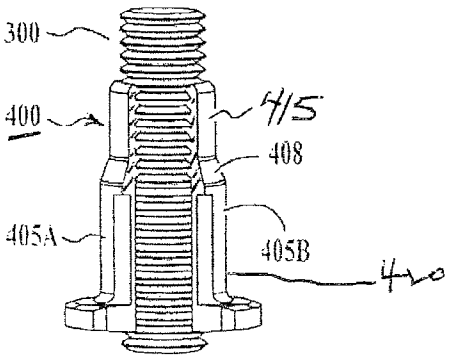
FIG. 8 is a view of the anchor member but with the stud being threaded in the receiver body portion, the stud extending downwardly in the boss portion in disposition thereof when bolt assembly is tightened.
Figure 6:
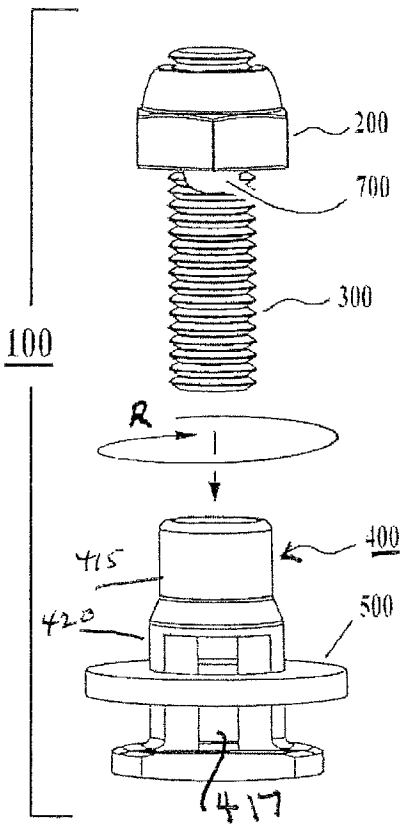
FIG. 6 is a partly exploded perspective view of the bolt assembly illustrating the tightening direction in which the bolt will be rotated on insertion thereof into the anchor member component of the assembly to initiate tightening as well as moving the stud downwardly in the anchor member.
Figure 5:
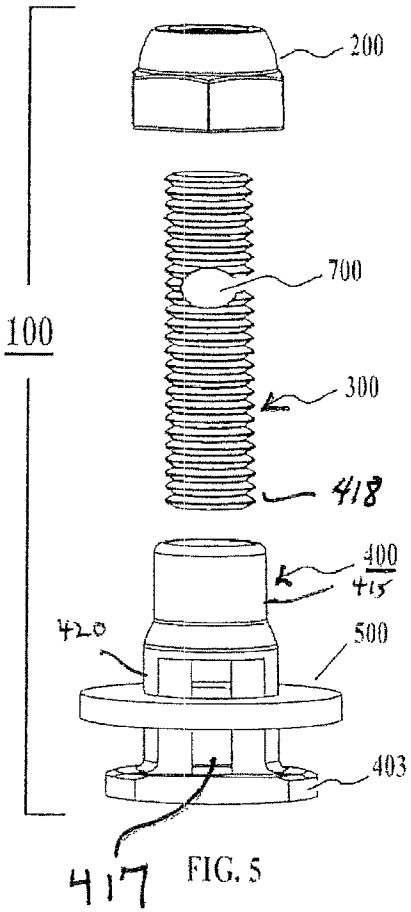
FIG. 5 is an exploded perspective view of the bolt assembly.

When hold down nut 200 is mounted at a top end segment of stud 300, the hold down nut can be freely rotated on the stud in up or down directions without rotating the stud, the extent of free downward hold down nut independent of any rotation of the stud being limited. An optional and advantageous limitation is effected by presence of a resistance means on the stud provided to produce a unitary rotation of the hold down nut and the stud. This means can comprise a deformed or narrowed thread segment 305 formed on the stud (FIG. 4). When the hold down nut 200 is being freely rotated on the stud 300 in the rotation direction R show by arrow in FIG. 6 and moving downwardly on the stud reaches the deformed thread segment 305, the hold down nut threads bind with the stud threads produce unitary rotary movement of the hold down nut and the stud. The result is the stud concurrent with rotation thereof moves downwardly into the anchor member in the direction of the vertical arrow in FIG. 6. The means to bind the hold down nut to the stud could be any means known to those of skill in the art and in a preferable embodiment may be an application of a self-hardening agent polymeric material such as a deposit 700 of LOCTITE® applied to a thread segment on the stud (FIG. 5).

Figure 9:
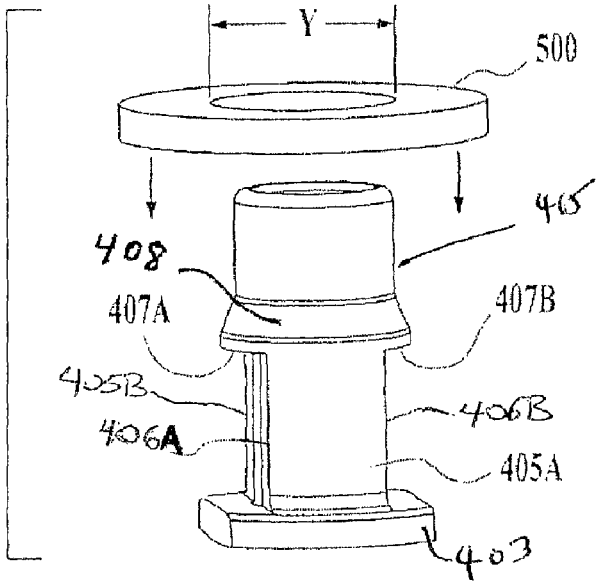
FIG. 9 is a perspective view of the anchor member with a first assembly washer positioned above the anchor member preliminary to the forced passage of the first washer over the skirted structure at the juncture of the upper and lower body portions to capture said first washer encircling the wall parts.
Figure 10:
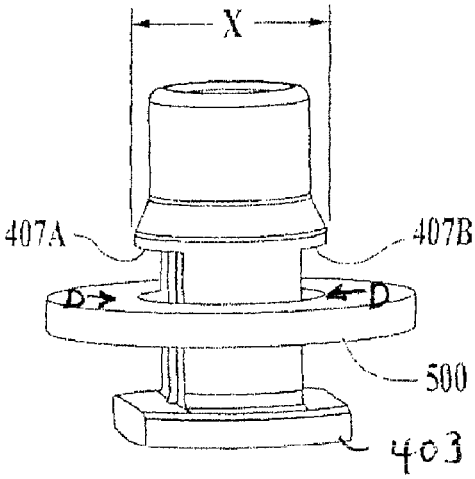
FIG. 10 is a perspective view depiction the arrangement after the washer has been pressed down past the skirted structure with the first washer now being captively slidably mounted but slidably moveable of the wall parts between the underface of the skirted structure and the top face of anchor member base.
Figure 11:
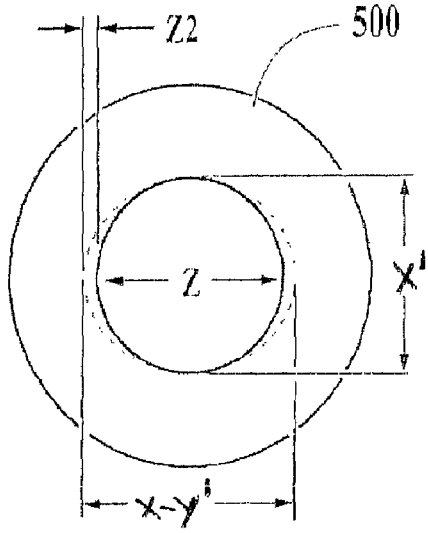
FIG. 11 is a plan view of the assembly first washer depicting in dashed lines the stress distortion of the washer imposed in consequence of forcing it past the skirted structure.

Referring now to FIGS. 9-11, when nylon washer 500 is subjected to forced passage over the skirted structure 408 having an outer diameter X and slid down to an encircling of the wall parts 405A and 405B, the washer becomes elastically deformed with the result that it cannot be again forced over the skirted structure 407A, 407B to remove it from the anchor member. FIG. 11 depicts the elastic deformation impart to the washer 500. The force passage of the washer over the skirted structure 408 results in a deformation of the normal circular inner diameter Y of the washer in a first outer direction X' to accommodate the outer diameter X of skirted structure 408 a certain distance, the diameter differences being on the order of a few thousandths to several millimeter (mm). Also following such forced passage of the washer, the inner diameter of washer 500 elastically deforms in a direction D, a second inwardly distance X-Y' to accommodate the opposing stretch in outer direction X' and balance the elastic energies related thereto. Consequently, washer 500 shortens its inner dimension to a dimension Z from its original inner dimension Y, or an amount Z2 on each side proximate each side wall region 406A, 406B, as shown. It will be recognized that this Z2 deformation of washer 500 on the wall parts impedes removal relative to cut in lips 407A, 407B but does not completely stop sliding or rotation of the washer up and down of the wall parts 405A, 405B.

Figure 12:
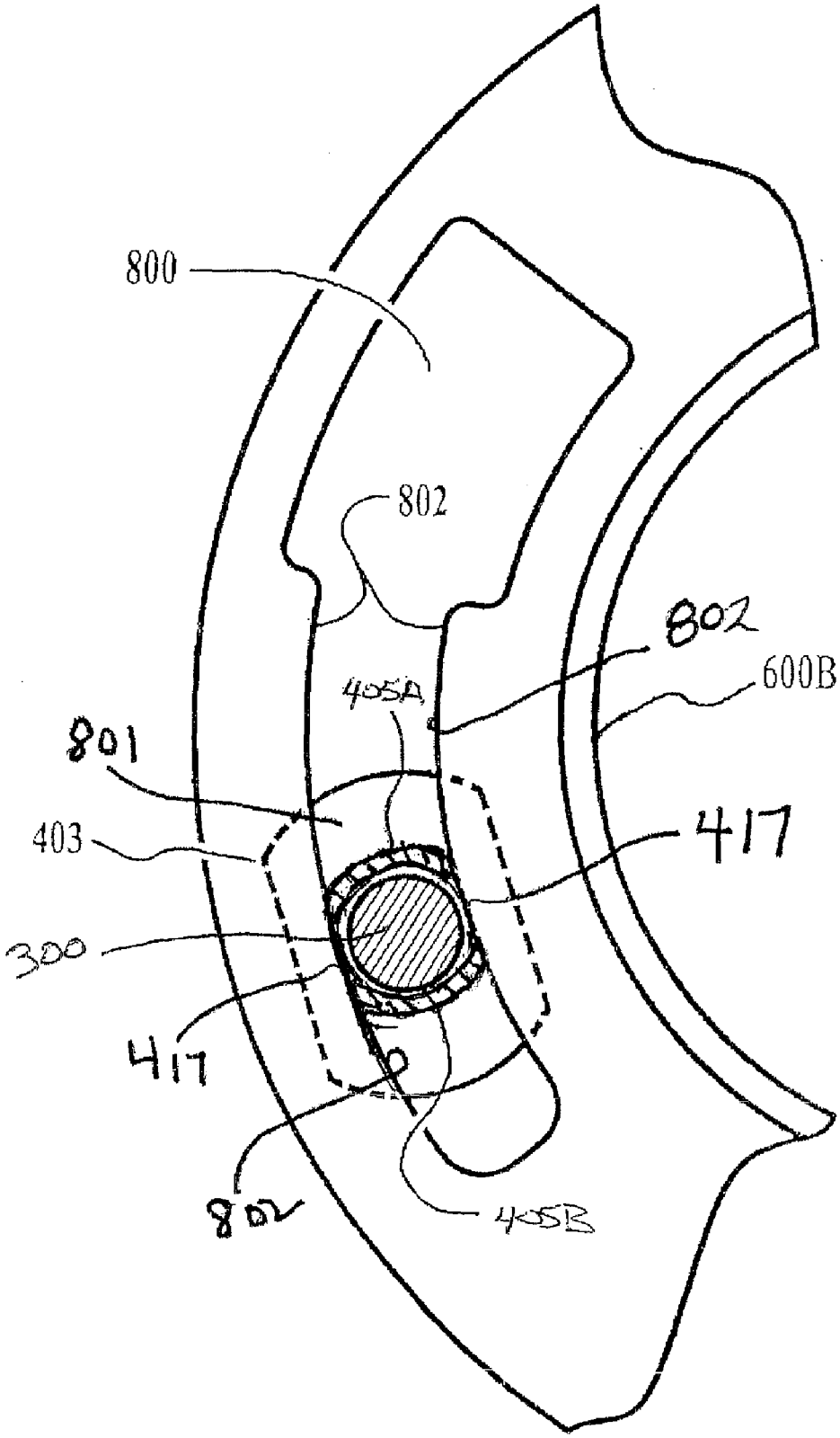
FIG. 12 is a fragmentary plan view partly in section showing how a 5/16" diameter stud large size stud is slidably accommodated in a clearance area defined by apertures in the oppositely facing wall parts in an anchor member as a result of cutting opposite side aperture openings in the anchor member lower body boss portion for sliding access.

As noted earlier herein, and as can be seen from FIG. 12, a particular advantage of the invention is that the presence of apertures 417 between the wall parts 405A, 405B in the anchor member 400 provides an enabling clearance area accommodating presence of the anchor member lower body portion in the closet flange arcuate course anchoring slotted openings 801. In contrast to the present invention, where a 5/16" diameter threaded bolt is received in a fully cylindrical length adjustment sleeve as in the Piper patent, such sleeve outside surface cannot enter slotted openings 801 being too wide for entering in between the walls 802, 802 of the slotted openings 801. As FIG. 12 depicts, the threads of the stud 300 of the present invention just fits between walls 802, 802 and side walls 406A, 406B prevent relative rotation to the slot side walls enabling an easy installation and operating as rotational resistant surfaces contacting respective side walls 802 during installation.

Figure 13:
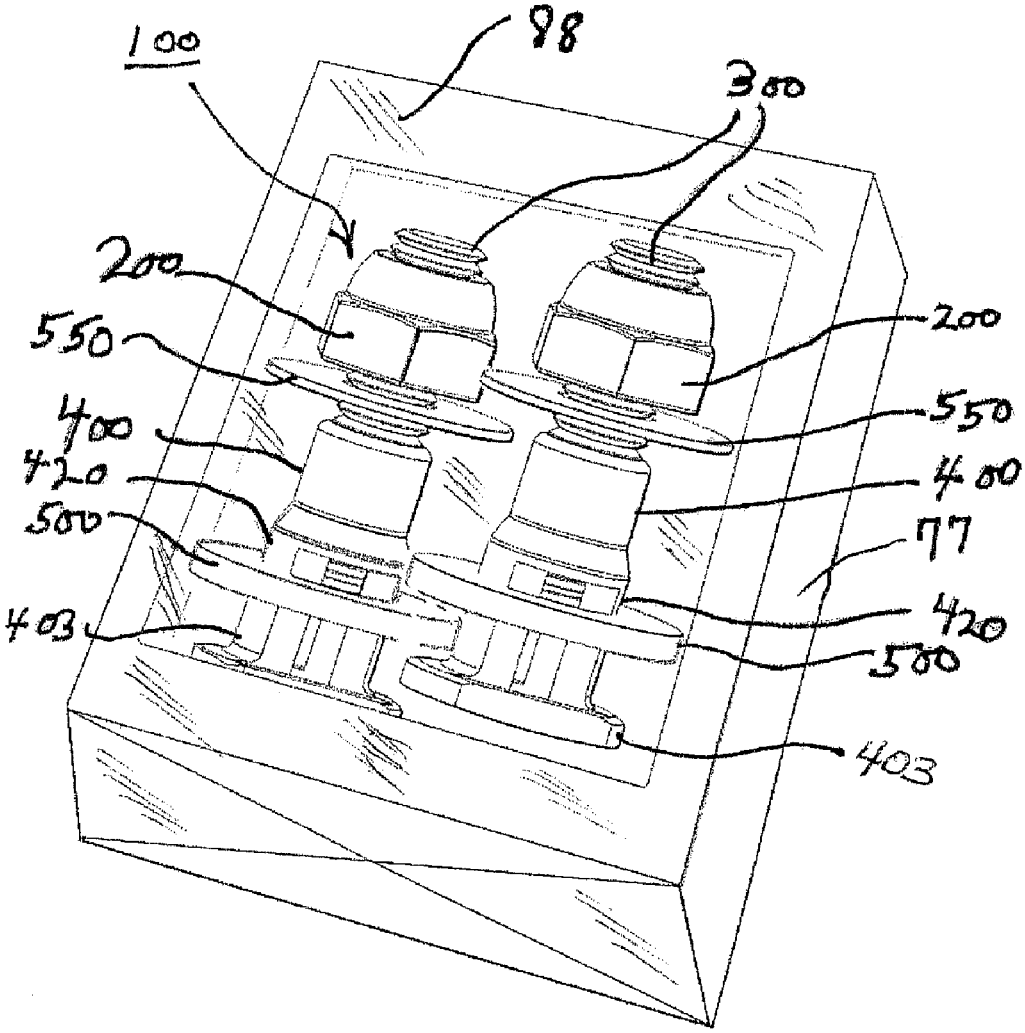
FIG. 13 is a perspective showing of an assembled toilet bolt provided in ready-to-use condition in a kit form package, the package including a receptacle receiving a pair of bolt assemblies and a transparent wrapper enclosing the receptacle.

The invention also provides as shown in FIG. 13, a kit of components parts for connecting a toilet to a connecting closet flange. The kit includes at least one components parts assembly 100, the assembly including an anchor member 400 having an upper body portion and a lower body portion. The upper body portion has a threaded through bore passing from an upper body portion top end to a location where the upper and lower body portions have a joinder juncture.

The lower body portion 420 comprises two spaced apart wall parts extending downwardly of the upper body portion, there a retainer web 403 is carried fixedly to a lower terminus of each wall part. A threaded stud 300, a hold down nut 200 and a first washer 500 are included in the assembly as is a second washer 550. The components are arranged in an assembly with a lower length portion of the stud threaded into an upper body bore passage with the first washer encircling the lower body wall parts, as shown although each member may be provided separately in wrapper 88 without departing from the spirit and scope of the present invention.

The hold down nut is threaded to an upper length part of the stud and the second washer is mounted on the stud intermediate the anchor member upper body portion intermediate a top end the anchor member upper body portion and a lower face of the hold down nut. The component parts assembly in wrapper 88 may be optionally received in a flexible sidewalled container such as a open top box 77, there being a transparent wrapper 88 encasing said container. It is advantageous that two assemblies be packaged in a container for sale since a bowl installation will require use of two assemblies.

In addition to the description above, it is noted that FIG. 1 depicts (in phantom outline) how a toilet bowl base 150 is positionally connected to the closet flange 600B when the assembly has been tightened with hold down nut. It is seen that the bottom face of the bowl base sits on top of the upper face of closet flange 600B, and the base upper face is engaged under a the lower face of a washer received on stud 300 next below the bottom of the hold down nut 200.

Referring again to FIG. 12, it is seen that the retainer webs carried on wall parts 405A and 405 B mount the anchor member to the flange 600B, this mounting being effected by inserting the retainer web parts 403 into enlarged entry end 800 of the arcuate course slotted openings 802 in the closet flange and at the underface of the flange. The web parts 403 are widened and extend under the structure of the closet flange, and need not be a continuous structure despite preference for same for strength reasons.

Referring again to the description of the FIGS. 1 and 2, the structure and function is replicated with respect to FIGS. 3 and 4, the these embodiments being identical except for the material from which the closet flange extension rings are made. One is made of metal while the other is plastic.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A self adjusting toilet bolt assembly, for connecting a toilet to a closet flange, the closet flange having reciprocally arranged arcuate course slotted openings passing from a top closet flange surface through the closet flange to a bottom face surface, said slotted openings having an enlarged slot entry region at one course end, said bolt assembly comprising:

a threaded stud;

an anchor member having an upper body portion and a lower body portion, said lower body portion comprising two spaced apart wall parts extending downwardly of said upper body portion with inner faces of said wall parts spaced facing each other, and a retainer web carried fixedly to a lower terminus of said wall parts, said upper body portion having a threaded through bore passing from at least an upper body portion top end to a location where said upper body portion has a juncture with said wall parts, a first end of said stud being threadedly receivable into said threaded bore, said retainer web having a central opening therein aligned with said upper body threaded bore;

a hold down nut threadedly receivable on a second opposite end of said stud;

a first washer encircling said lower body wall parts and slidably moveable on said wall parts between said retainer web and the juncture of said wall parts with said upper body part;

wherein said upper body portion includes an upper section of cylindrical shape, and a lower section of frusto-conical shape, said first washer being made of a deformable material to enable a non-reversible force passage of said first washer over the lower frusto-conical section thereby to elongate the washer in one direction and laterally minimize the washer in a second direction thereby preventing unintended removal of said first washer from said wall parts but allowing a sliding of said first washer on said wall parts, and connection of the toilet to the closet flange bolt assembly being effected by threading the stud into the anchor member and locating the first washer on the lower body portion proximal the wall parts-upper body portion juncture, followed by inserting the lower body portion through the closet flange slot entry region to locate the retainer web below an underface structure of said closet flange adjacent the flange slotted opening and then sliding said lower body along the flange arcuate opening to a desired location, then receiving an opening in a base part of a toilet bowl around said stud, rotating said stud downwardly in said anchor member to a desired height above a top surface of said toilet bottom part, followed by mounting said hold down nut on said stud and tightening the assembly components together with the hold down nut to affix the toilet bowl to the closet flange.

2. The self adjusting toilet bolt assembly in accordance with claim 1, wherein said lower body wall parts are integral with said upper body portion.

3. The self adjusting toilet bolt assembly in accordance with claim 1, wherein said inner faces of said lower body wall parts are formed with at least one of threaded surfaces and smooth surfaces.

4. The self adjusting toilet bolt assembly in accordance with claim 1, wherein said inner faces of said lower body wall parts are provided with stud companionable threads.

5. The self adjusting toilet bolt assembly in accordance with claim 1, further comprising means carried on said stud proximal said stud second opposite end effective to produce unitary rotation of said stud with said hold down nut thereby enabling adjustment downwardly of said stud into the anchor member to a position wherein a lower segment of the stud locates in said flange arcuate course slot entry.

6. The self adjusting toilet bolt assembly in accordance with claim 5, wherein said unitary rotation producing means comprises a deformed thread segment on said stud.

7. The self adjusting toilet bolt assembly in accordance with claim 5, wherein said unitary rotation producing means comprises an interference deposit of a self-hardening material applied to a thread segment on said stud.

8. The self adjusting toilet bolt assembly in accordance with claim 7, wherein said self-hardening material comprises a deposit of polymeric material.

9. The self adjusting toilet bolt assembly in accordance with claim 1, wherein said lower body wall parts are circularly spaced one from a other, the circular spacing between said wall parts defining apertures enabling clearance accommodating presence of said anchor member lower body portion in the closet flange slotted openings.

10. A kit of component parts, for connecting a toilet to a connecting closet flange having an anchoring slot, the kit comprising:

an anchor member having an upper body portion and a lower body portion, said upper body portion having a threaded through bore passing from a upper body portion top end to a location where said upper body portion has juncture with said lower body portion, said lower body portion comprising two spaced apart wall parts extending downwardly of said upper body portion, and a retainer web carried fixedly to a lower terminus of said wall parts;

a threaded stud;

a hold down nut;

at least a first washer, wherein said upper body portion includes an upper section of cylindrical shape, and a lower section of frusto-conical shape, said first washer being made of a deformable material to enable a non-reversible force passage of said first washer over the lower frusto-conical section thereby to elongate the washer in one direction and laterally minimize the washer in a second direction thereby preventing unintended removal of said first washer from said wall parts but allowing a sliding of said first washer on said wall parts, and said components being arranged together in an assembly with a lower length portion of said stud threaded into said upper body bore passage, said hold down nut threaded to an upper length part of said stud, the space between said side wall parts defining oppositely located apertures in said lower body portion, said apertures providing clearance spaces enabling reception of said lower body portion in said anchoring slot of said closet flange, said at least first washer being mounted on said stud proximate said anchor member lower body portion side wall;

a container in which said component parts assembly is received; and a wrapper encasing said container.

11. The kit in accordance with claim 10, wherein said wrapper is transparent.

* * * * *